United States Patent [19]

Born

[11] 4,013,989

[45] Mar. 22, 1977

[54] FUSIBLE ELECTRIC CONTROL DEVICE

[75] Inventor: William F. Born, Beaver, Pa.

[73] Assignee: Westinghouse Electric Corporation, Pittsburgh, Pa.

[22] Filed: Mar. 25, 1975

[21] Appl. No.: 561,726

[52] U.S. Cl. ..... 337/227; 337/186; 337/201; 337/228; 337/263

[51] Int. Cl.[2] ..... H01H 85/14

[58] Field of Search ..... 337/186, 187, 201, 207, 337/227, 228, 229, 230, 256, 263, 264; 317/114; 335/142

[56] References Cited

UNITED STATES PATENTS

| | | | |
|---|---|---|---|
| 3,248,500 | 4/1966 | Cellerini et al. | 337/186 |
| 3,360,622 | 12/1967 | Bassani | 337/228 |
| 3,471,817 | 10/1969 | Marechal | 337/186 X |
| 3,486,154 | 12/1969 | Seagrave et al. | 337/227 X |
| 3,813,626 | 5/1974 | Cetola | 337/186 X |
| 3,828,290 | 8/1974 | Kawiecki | 337/186 |

*Primary Examiner*—J. D. Miller
*Assistant Examiner*—Fred E. Bell
*Attorney, Agent, or Firm*—Robert E. Converse, Jr.

[57] ABSTRACT

A fusible electric contactor having a plurality of cavities and a movable member having a path of movement into the cavities. A fuse assembly is removably inserted within the cavities to occupy a volume within the confines of the height, width, and length of the contactor.

7 Claims, 14 Drawing Figures

FIG. 7
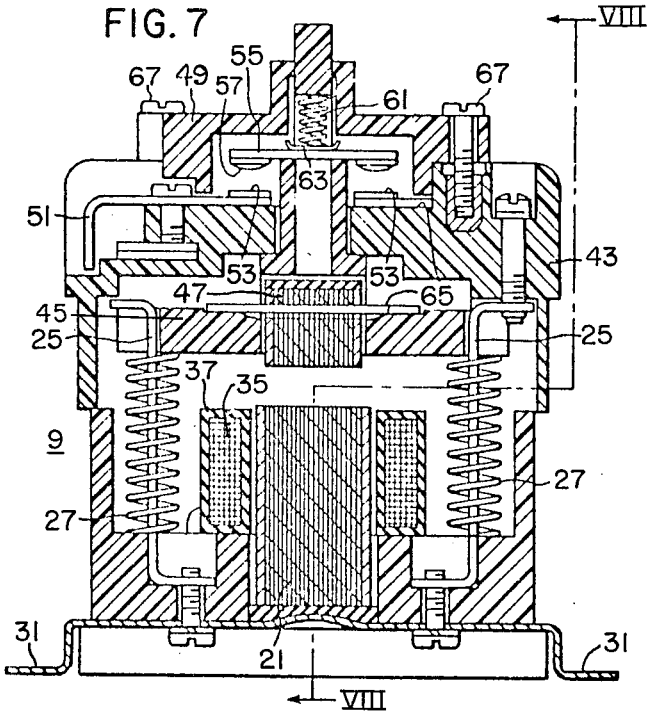
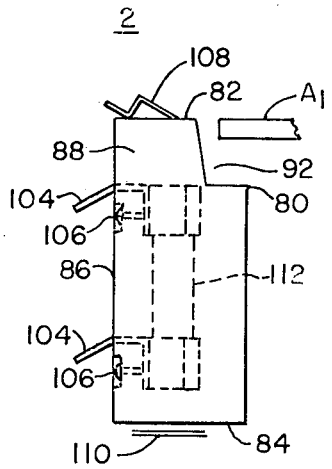
FIG. 9
FIG. 8
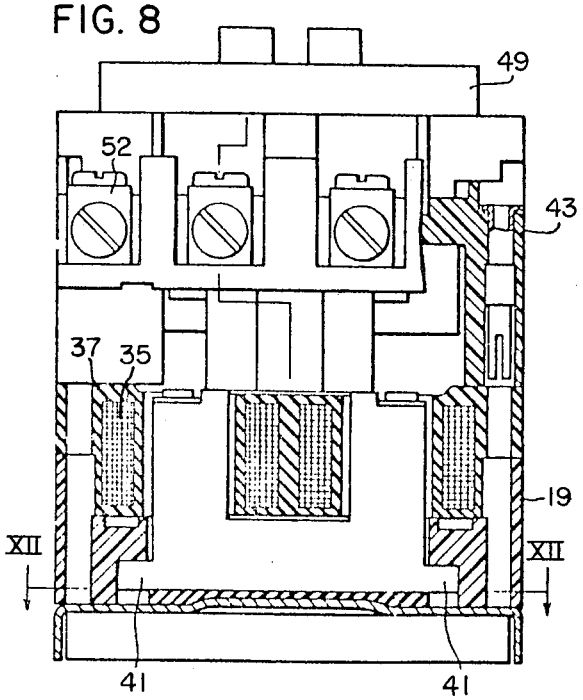
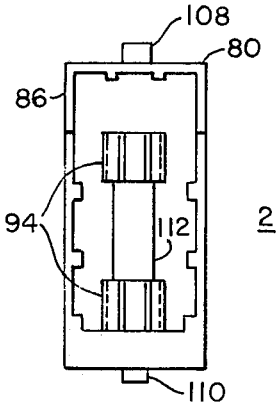
FIG. 10
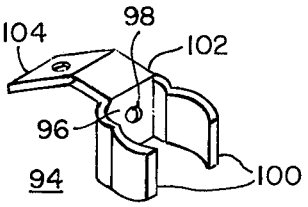
FIG. 11

FUSIBLE ELECTRIC CONTROL DEVICE

BACKGROUND OF THE INVENTION

1. Field of the Invention

The invention relates generally to electric control equipment and more particularly to electrical control equipment requiring protective fuses.

2. Description of the Prior Art

In commercial amd industrial installations, electrical apparatus such as pumps, motors, fans and other equipment is controlled by contactors or relays mounted or enclosed in operating panels. The contactors and relays in turn are manually or automatically operated by control circuits. Safety considerations dictate that this control circuitry be protected by fuses whenever it leaves the enclosure in which the contactor or relay is situated. In addition, it is sometimes desirable to protect the control circuitry by fuses even when the circuitry does not leave the relay or contactor enclosure.

Previously, fuses for the control circuitry of relays and contactors have been mounted upon channels similar to terminal strips. Alternatively, the fuses have been mounted upon the contactor or relay panels. Both of these methods, however, require additional panel space and in many installations such space is at a premium. It may then be necessary to enlarge enclosures or install additional enclosures, thereby increasing the cost of the installation.

Often it is not known until late in the installation process whether fusing will be required for the control circuitry. Using prior methods, it was often extremely inconvenient to add such fusing to the installation.

It is desirable to provide an electric control device to which fuse protection can be conveniently added at any stage in the installation process without requiring additional panel space. It is also desirable to provide an electric control device adaptable for use with either standard cartridge-type fuses or reject-type fuses.

Contactors of the type described in U.S. Pat. No. 3,296,567 issued on Jan. 3, 1967 to John P. Conner and Kurt A. Grunert and assigned to the assignee of the present application include provision for mounting additional contacts, pole units, or interlocks for actuation by the operating mechanism of the contactor. It is desirable to provide a fusible electric control device compatible with such contactors.

SUMMARY OF THE INVENTION

In accordance with the principles of the present invention, there is provided an electrical control device comprising an insulating housing having a length, a width, a height, and at least one cavity therein; and a control mechanism comprising a plurality of contacts operable between open and closed operating positions, an electromagnet, means for energizing the electromagnet, and a movable member. The electromagnet is operable between energized and de-energized conditions so that energization of the electromagnet causes the movable member to operate the contacts from one to the other of said operating positions. The path of movement of the movable member extends into the cavity. A fuse assembly is provided comprising a second insulating housing and fuse clips operable to engage a fuse. The assembly is removably disposed within the cavity to occupy a volume within the confines of the length, width and height of the first housing. The second housing has a cut-out to prevent interference with the path of movement of the movable member.

BRIEF DESCRIPTION OF THE DRAWING

The invention, both as to construction and operation, will be best understood from the following detailed description when read in conjunction with the accompanying drawings in which:

FIG. 7 is a sectional view taken generally along the line VII—VII of FIG. 4;

FIG. 8 is a sectional view taken generally along the line VIII—VIII of FIG. 7;

FIG. 9 is a side elevational view of a fuse holder assembly, including a portion of the contact carrier shown in FIG. 13;

FIG. 10 is a rear elevational view of the fuse holder assembly seen in FIG. 9;

FIG. 11 is an isometric view of one of the fuse clips of the fuse holder assembly;

DESCRIPTION OF THE PREFERRED EMBODIMENT

Figure 1:
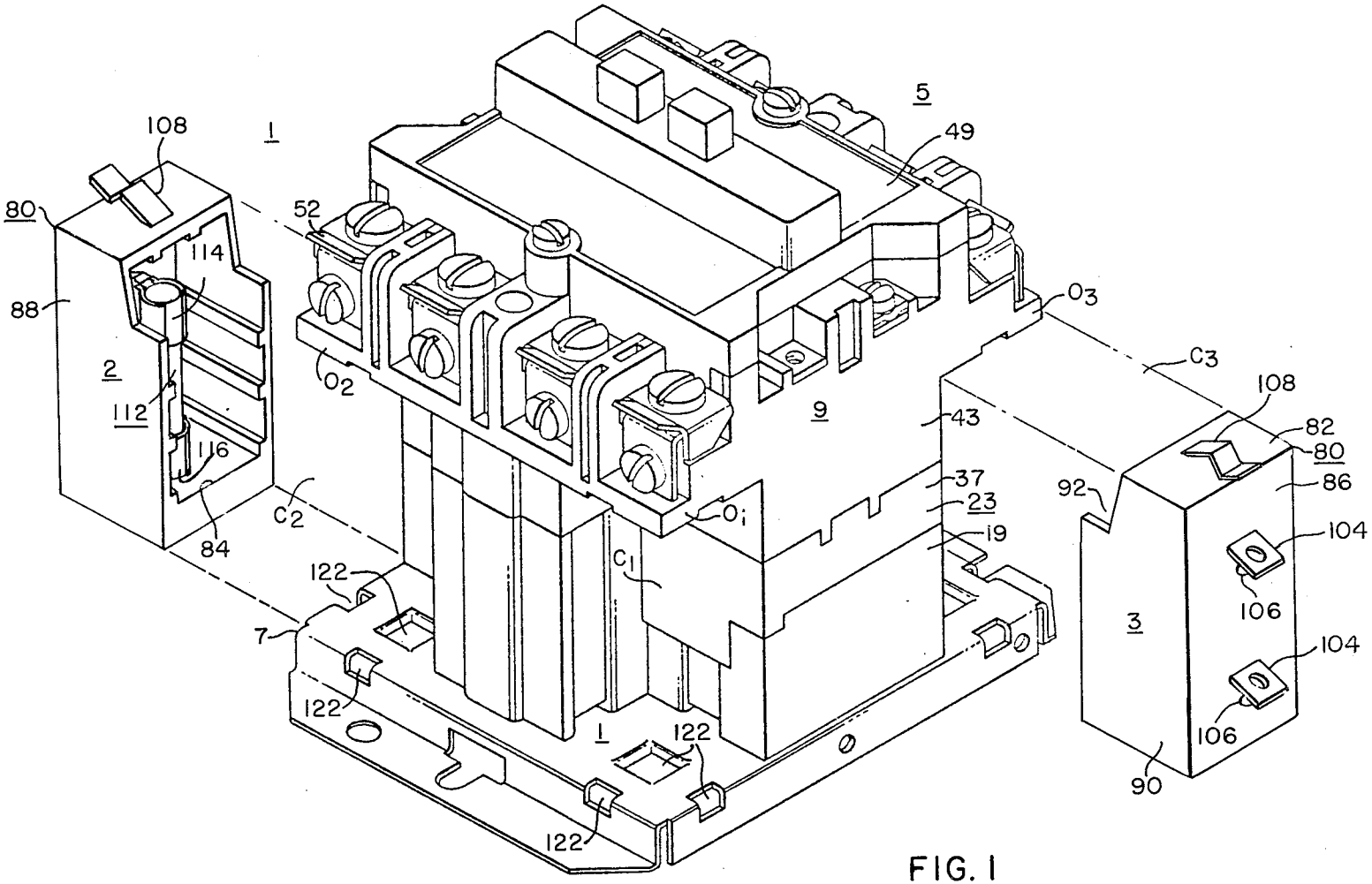
FIG. 1 is an isometric view of a fusible electric control structure including two removable fuse assemblies constructed in accordance with the principles of this invention.

Throughout the drawings, like reference characters refer to like elements.

Referring to the drawings, there is shown in FIG. 1 an electric control structure 1 comprising two fuse assemblies 2 and 3 and an electric control device or contactor 5. The contactor 5 comprises a metallic base plate 7 and a contactor structure 9. The contactor 5 is a contactor of the type that is more specifically described in the aforementioned U.S. Pat. No. 3,296,567.

Figure 2A:
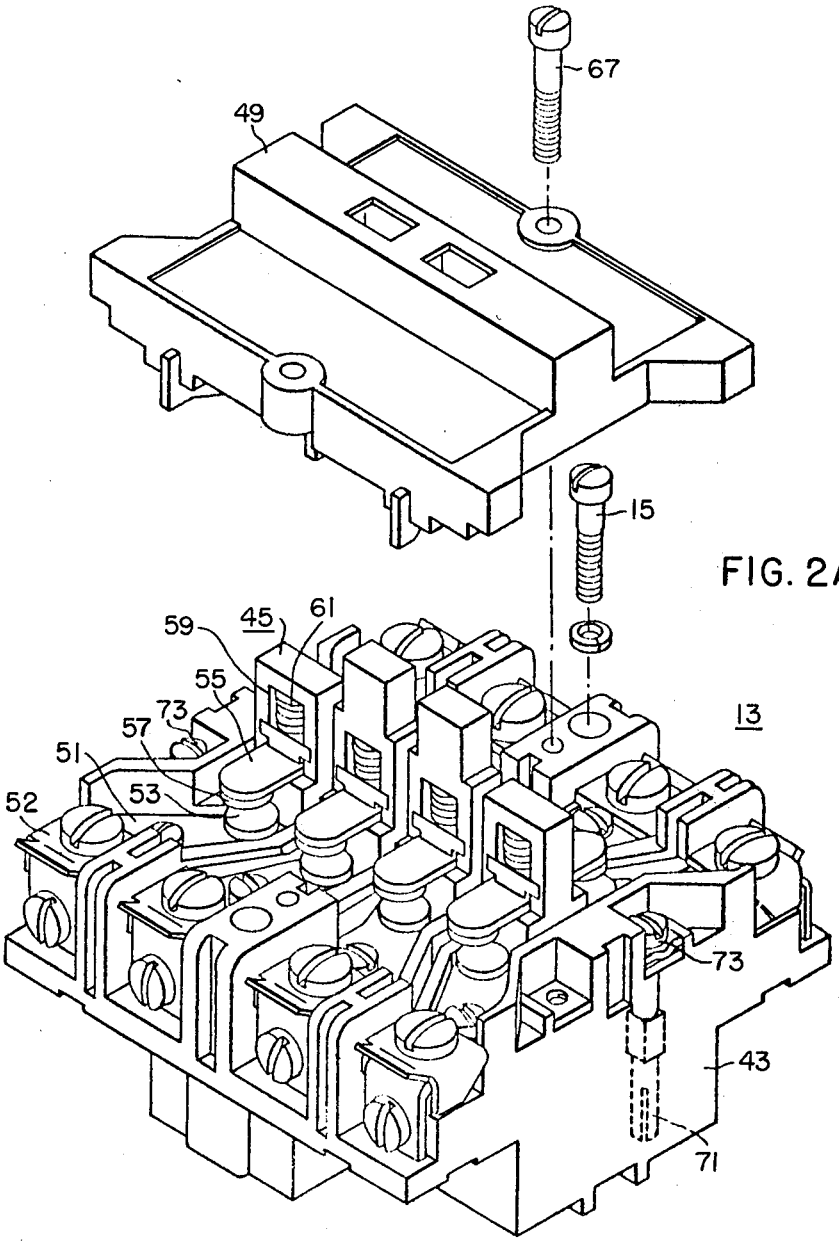
FIG. 2A is an exploded isometric view of the front part of the control device seen in FIG. 1.

The contactor structure 9 comprises a back part 11 (FIG. 2B) and a front part 13 (FIG. 2A) which parts are connected together by means of two screws 15 (only one screw 15 being shown in FIG. 2A). The contactor structure 9 is secured to the metallic base plate 7 by means of two screws 17 (only one screw 17 being shown in FIG. 2B).

Figure 2B:
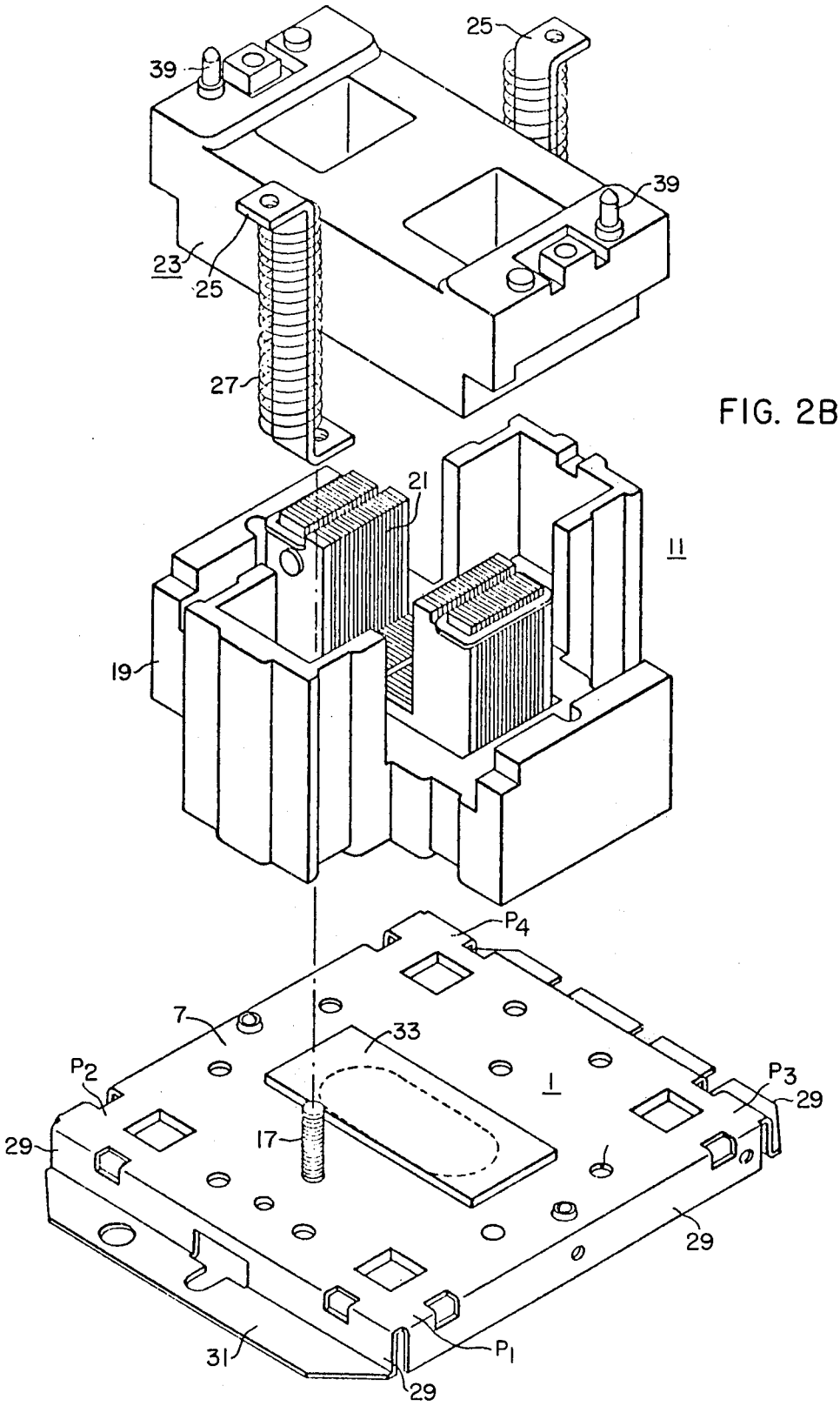
FIG. 2B is an exploded isometric view of the back part of the control device seen in FIG. 1.

As can be seen in FIG. 2B, the back part 11 of the contactor structure 9 comprises a back insulating housing part 19, a generally U-shaped magnetic core member 21, a coil structure 23, two generally Z-shaped supports 25 and two spring members 27 disposed over the supports 25. The mounting plate 7 comprises a sheet metal plate member bent over at the four sides thereof to form four leg portions 29, two of which leg portions are bent over to form flat flange parts 31 (FIGS. 2B and 7). A shock-absorbing elastomeric or rubber member 33 (FIG. 2B) is supported on the plate 7 below the core member 21. The coil structure 23 comprises a conducting coil 35 (FIGS. 7 and 8) encapsulated in an insulating shell 37. Two stab-type terminals 39 (FIG. 2B) extend from the insulating shell 37 to enable connection of the coil in an electric circuit. As can be seen in FIG. 2B, the coil structure 23 has two openings therein which receive two legs of the generally U-shaped magnetic core member 21. The core member 21 is provided with two extensions 41 (FIG. 8) that are disposed under suitable ledges on the insulating housing part 19 to maintain the coil in place. The screws 17 (FIG. 2B), which pass through the mounting plate 7 and supports 25, draw the supports 25 and insulating housing part 19 toward the plate 7 capturing the coil 23 between the housing part 19 and the plate 7.

Figure 3:
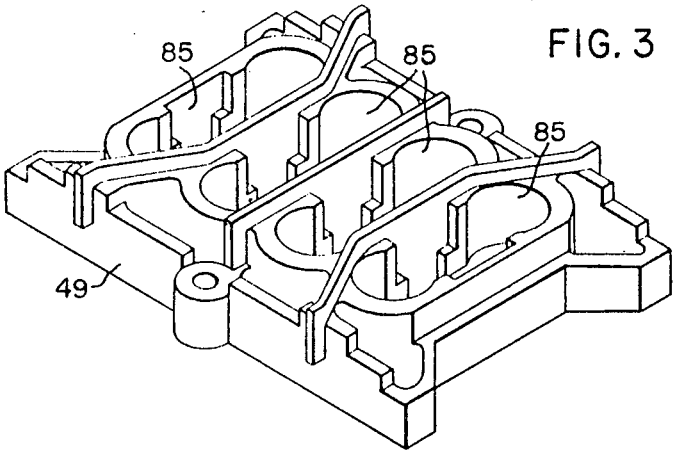
FIG. 3 is an isometric view of the arc-hood device seen in FIGS. 1 and 2A, with the device being turned over from the position in which it appears in FIGS. 1 and 2A.
Figure 13:
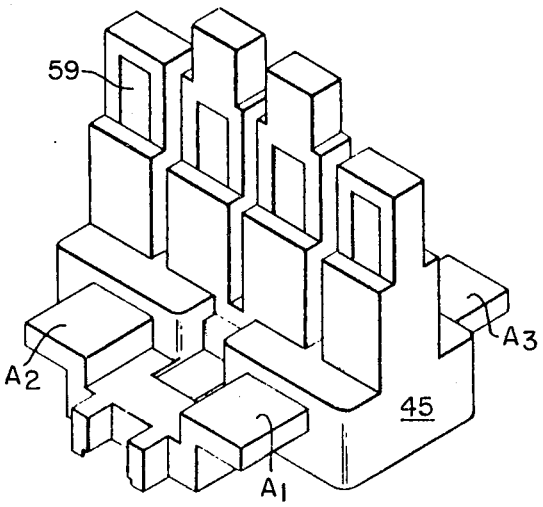
FIG. 13 is an isometric view of the insulating contact carrier seen in FIGS. 2A and 7.
Figure 4:
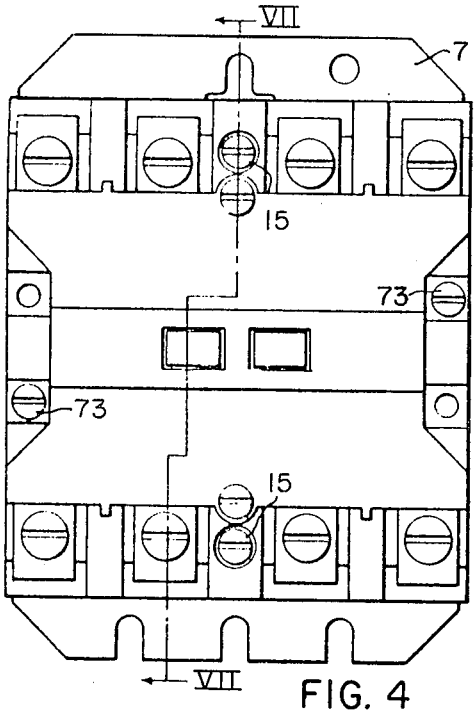
FIG. 4 is a top plan view of the control device seen in FIG. 1.
Figure 5:
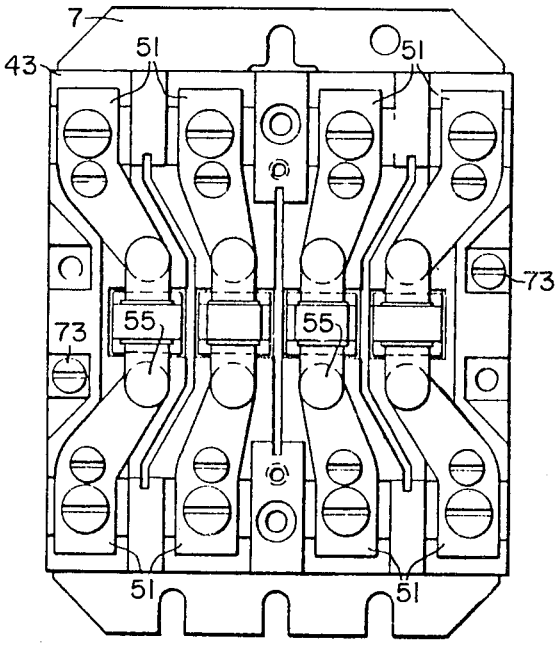
FIG. 5 is a plan view, with the arc-hood removed, of the control device of FIG. 4.

Referring to FIGS. 1, 2A, 6 and 13, the top or front part 13 of the contactor structure 9 comprises an upper housing part 43 of molded insulating material, a molded insulating actuating member or contact carrier 45, a generally U-shaped magnetic armature 47 (FIG. 7) and an insulating arc-hood device 49. The generally U-shaped armature 47 is positioned with the opposite leg portions thereof opposite the legs of the core member 21. As is best seen in FIGS. 2A and 7, four pairs of conducting straps 51 are suitably secured to the insulating housing part 43. A solderless terminal connector 52 is connected to the external end of each of the conductors 51 (FIGS. 1 and 8). A stationary contact 53 (FIGS. 2A and 7) is brazed or otherwise suitably secured to the inner end of each of the conductors 51. A separate bridging contact member 55, having a contact 57 at each of the opposite ends thereof, is provided to bridge each pair of separated stationary contacts 53. As is best seen in FIGS. 2A and 13, the insulating contact carrier has four window openings 59 therein. Each of the bridging contact members 55 is supported on the contact carrier or actuator 45 in a separate one of the window openings 59. In each of the openings 59 a separate compression spring 61 (FIGS. 2A and 7) biases a spring support 63 (FIG. 7) against the associated bridging contact member 55 to retain the member 55 in place and to provide for resilient contact engagement and contact pressure. As can be seen in FIG. 7, the insulating contact carrier 45 has an opening therein, and the armature 47 is supported on the contact carrier in the opening by means of a supporting pin 65 that passes through a suitable opening in the armature 47 and is supported on a ledge surface of the insulating contact carrier 45. During assembly of the upper or front part 13 (FIG. 2A), the insulating contact carrier 45 and armature 57 are moved up through an opening from the bottom of the insulating housing part 43 and, thereafter, the bridging contact members 55 are placed in position in the window openings of the contact carrier 45 to thereby secure the insulating contact carrier 45 and armature 47 along with the bridging contact members 55 in position on the upper housing part 43. The arc-hood device 49 (FIG. 3) is a molded insulating member having four arc chambers 85 formed therein to extinguish the arcs drawn between the separating contacts of the four pole units of the contactor 9. Although only one of the pole units is specifically described with reference to FIG. 7, it can be understood that all of the pole units are constructed in the same manner to be simultaneously operated by operation of the electromagnet 21, 47. The arc-hood device 49 is secured to the upper housing part 43 by means of two screws 67 (FIGS. 2A and 7). The front or upper part 13 (FIG. 2A) is secured to the back or lower part 11 (FIG. 2B) by means of the two screws 15 (only one of which is shown in FIG. 2A). Each of the screws 15 is threaded into an upper tapped opening in a different one of the two supports 25. The two springs 27 (FIG. 7) engage the contact carrier 45 to bias the contact carrier 45, armature 47 and bridging contact members 55 to the upper unattracted position seen in FIG. 7. Suitable electric socket members 71 (one of which is shown in FIG. 2A) are positioned to receive the stab connectors 39 (FIG. 2B) of the coil 23. A separate external terminal connector 73 (FIG. 2A) is provided to enable connection of the coil 35 in an electric circuit through the stabs 39 and sockets 71. The terminal connectors 73 are externally accessible.

Referring to FIG. 7, the contactor structure 9 is shown therein with the contact carrier 45 and armature 47 biased to the upper unattracted position by means of the springs 27. When the contact carrier 45 is in this position, the four bridging contact members 55 are in the upper position with the movable contacts 57 separated from the stationary contacts 53. Thus, the four poles of the contactor are normally opened. It can be understood that the contactor can be constructed with more or less than four poles and that the poles can be constructed to provide either normally open or normally closed operation in a manner well known in the art. Upon energization of the coil 35, the armature 47 is attracted, against the bias of the springs 27, into engagement with the core 21. This movement is limited by engagement of the pole faces of the armature with the pole faces of the core member 21. During this movement, the springs 27 are charged and the four bridging contact members 55 are moved down, moving the contacts 57 into engagement with the contacts 53 whereby each of the bridging contact members 55 closes the circuit between the associated stationary contacts 53. Each of the springs 61 is compressed slightly during the closing operation to provide contact pressure between the closed contacts. With the armature 47 in engagement with the core 21, and with the contact carrier 45 in the lower position, when the coil is deenergized, the charged springs 27 will expand moving the insulating contact carrier 45 upward to the position seen in FIG. 7 during which movement the insulating contact carrier 45, armature 47 and the four bridging contact members 55 are moved upward to the unattracted position. The upward movement is limited by engagement of suitable parts of the insulating carrier 45 with stop means on the insulating housing part 43. The insulating contact carrier 45 is shaped to fit in suitable openings in the housing part 43 in such a manner that the contact carrier 45 is guided in the openings for generally rectilinear vertical (FIGS. 7 and 8) movement between the opened and closed positions.

Referring now to FIGS. 1, 9 and 10, there is shown a fuse assembly 2 comprising an insulating housing 80. The insulating housing 80 includes a top member 82, a bottom member 84, a front member 86 and two side members 88, 90. The two side members 88, 90 include cut-out sections 92 to provide clearance for the corners $A_1$, $A_2$, $A_3$, or $A_4$ (FIG. 13) of the contact carrier 45 of the control device 5 as will be hereinafter described. As can be seen in FIG. 10, the back side of the insulating housing 80 is open to provide access to two fuse clips 94. The fuse clips 94, one of which is shown more clearly in FIG. 11, include a base member 96 having a threaded aperture 98. Extending from the base member 96 are two curved ears 100 adapted to receive the cylindrical terminals of a standard cartridge-type fuse. Extending from the base member 96 in the direction opposite to the two ears 100 is a conductor member 102 and a terminal member 104 extending at an angle from the conducting member 102. Alternatively, a separate terminal member and fuse clip riveted together could be provided.

The terminal member 104 of each fuse clip 94 is inserted from the interior volume of the insulating housing 82 through a slot in the front member 86 of the insulating housing 82 as is shown in FIG. 1. The fuse clips 94 are secured to the front member 86 of the insulating housing 82 by screws 106 which extend through the front member 86 and are threaded into the apertures 98 of the base member 96.

Attached to the top and bottom members 82 and 84 of the insulating housing 80 are fastener clips 108 and 110 of spring steel. As is shown in FIG. 1, a standard cartridge type fuse 112 is mounted in the fuse assembly 1 by snapping the terminals 114 and 116 of the fuse 112 into engagement with the ears 100 of the fuse clips 94.

Figure 12:
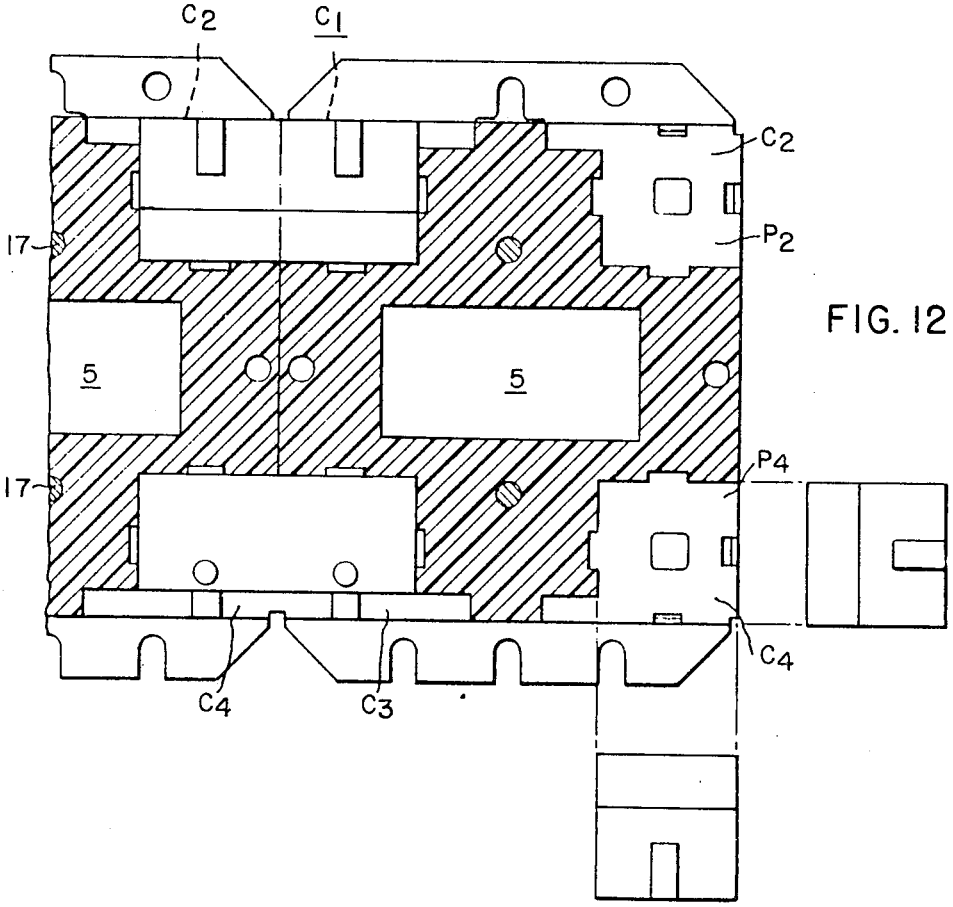
FIG. 12 is a sectional view taken generally along the line XII—XII of FIG. 8 of two identical control devices, of the type herein described, mounted in a substantially abutting side-by-side relationship.

It will be noted in FIG. 1 that the insulating housing part 19, the insulating cover 37 of the coil structure 23, and the insulating housing part 43 all mate and cooperate, along with the insulating arc-hood device 49, to form the insulating housing structure of the contactor structure 9. The insulating parts 19, 37, and 43 are formed to provide 4 cavities; one cavity at each of the back four corners of the contactor. The cavities are identified as $C_1$, $C_2$, $C_3$ and $C_4$. The cavity $C_4$ which cannot be seen in FIG. 1 is seen in FIG. 12. Each of the four cavities is either identical or symmetrically identical to each of the three other of the four cavities. The insulating housing part 43 overhangs the four cavities $C_1$, $C_2$, $C_3$, and $C_4$ at the four corners $O_1$, $O_2$, $O_3$ and $O_4$ thereof (FIG. 1) respectively. The four corners $P_1$, $P_2$, $P_3$ and $P_4$ (FIGS. 2B and 12) of the mounting plate 7 serve as the four bases of the cavities $C_1$, $C_2$, $C_3$ and $C_4$, respectively.

Figure 6:
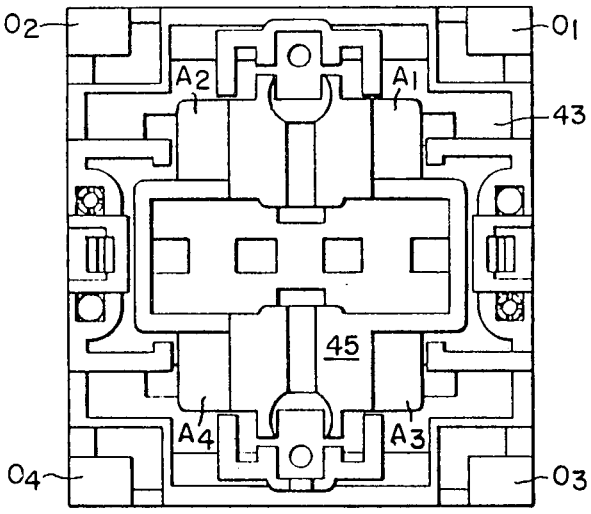
FIG. 6 is a bottom plan view of the front part of the control device of FIG. 1.

Referring to FIGS. 6 and 13, it will be noted that the movable actuating member for insulating contact carrier 45 is provided with four actuating parts or corners $A_1$, $A_2$, $A_3$ and $A_4$ molded as integral insulating parts of the insulating contact carrier. Each of the four corners $A_1$, $A_2$, $A_3$, and $A_4$ serves as an actuating part moving rectilinearly in the associated cavity in a vertical (FIGS. 7 and 8) direction with the integral insulating contact carrier 45 to thereby engage and actuate a supplemental contact device or pole unit such as is described in U.S. Pat. No. 3,382,469 issued May 7, 1968 to John P. Conner and assigned to the assignee of the present application.

As can be seen in FIG. 1, the fuse assembly 2 is removably disposed within any of the cavities $C_1$, $C_2$, $C_3$ and $C_4$. The fastening clips 108 and 110 engage apertures 122 in the base plate 7 and recesses (not shown) in the insulating housing part 43, thereby firmly securing the fuse assembly 2 to the contactor structure 9.

When the fuse assembly 2 is mounted in any of the cavities, only the terminals 104 extend past the top plan view dimensions of the mounting plate. Thus, it can be seen that the fuse assembly does not take up substantial additional panel space in a panelboard or control center. It is to be understood that a plurality of the control structures can be mounted in generally parallel spaced rows in a substantially abutting side-by-side relationship and only the terminals 104 of the fuse assembly 2 will extend past the top plan view dimensions of the control devices 5 into the space between the rows. Most of the volume of the main body portion of each of these fuse assemblies fits within the confines of the associated cavity of the insulating housing part of the contactor structure 9.

It is to be noted that the cut-out section 92 (FIG. 9) of the side members 88 allows the corners $A_1$, $A_2$, $A_3$ and $A_4$ to freely move within the associated cavity even when the fuse assembly is inserted. Thus, the insertion of the fuse assembly will in no way interfere with the operation of the control device 5. Supplemental contact devices or auxiliary pole units can also be inserted in any of the remaining cavities and their operation will be similarly unaffected by the presence of a fuse assembly in one or more of the remaining cavities.

The terminals 104 of the fuse assembly 2 can be connected in series with the control circuitry associated with the energization and deenergization of the electromagnet 21, 47, thereby providing fuse protection for the control device 5 itself. Alternatively, the terminals 104 can be connected to provide protection for circuitry and equipment other than the control circuitry of the device 5.

It is to be noted that fuse clips of types other than that of the clips 94 could be mounted in the insulating housing 80 in a similar manner. For example, clips adapted to engage reject-type fuses and prevent insertion of standard cartridge-type fuses could be so mounted.

Each fuse assembly can be mounted in any of the four cavities in the control device in either of the two alternate positions indicated and described with reference to the cavity $C_4$ in FIG. 12. For certain applications, as many as four fuse assemblies could be so inserted. With the terminals of the fuse assembly extending slightly into the spaces between spaced rows of substantially abutting control structures which spaces serve as wiring channels whereby the terminals are accessible for wiring in the wiring channels, the fuse assemblies can be mounted in position without necessitating an increase in panel space over the amount of panel space that would otherwise be utilized merely by the rows of control devices themselves. In addition, the fuse assembly can be easily inserted even after installation of the control devices. Thus, it is possible to provide fuse protection for the control circuitry of the devices or for any other desired purpose at any time during or after the completion of installation of the operating panel or control center.

Since numerous changes may be made in the abovedescribed construction, and because different embodiments of the invention may be made without departing from the spirit and scope of the invention, it is intended that all matter contained in the foregoing description or shown in the accompanying drawings be interpreted as illustrative and not in a limiting sense.

I claim:

1. An electric control device, comprising:

a first insulating housing having a length, a width, a height, and at least one cavity;

a control mechanism comprising a plurality of contacts, a movable member for operating said contacts between open and closed operating positions, an electromagnet, and means for energizing said electromagnet; energization of said electromagnet causing said movable member to operate said contacts from one to the other of said operating positions; the path of movement of said movable member extending into said at least one cavity; and at least one fuse assembly comprising a second insulating housing, means within said second insulating housing for engaging a fuse, and terminal means associated with said engaging means for electrically connecting a fuse to apparatus to be protected; said fuse assemblies being removably disposed within said cavities to occupy a volume substantially within the confines of said length, width and height of said first housing, said second insulating housing comprising means defining a cutout preventing interference with the path of movement of said movable member.

2. An electric control device as recited in claim 1 comprising four cavities symmetrically disposed about said first insulating housing.

3. An electric control device as recited in claim 2 wherein said engaging means comprises a plurality of fuse clips.

4. An electric control device as recited in claim 1 wherein said movable member comprises a contact carrier supporting at least one of said contacts.

5. An electric control device, comprising:

a first insulating housing having a length, a width, a height, and at least one cavity;

a control mechanism comprising a plurality of main contacts operable between open and closed positions, an electromagnet, means for energizing said electromagnet, and a movable member extending into said cavities for engaging auxiliary contacts of removable supplemental contact devices seated in said cavities, energization of said electromagnet operating said main contacts between open and closed positions and moving said movable member to operate the auxiliary contacts of any supplemental contact devices inserted in said cavities; and at least one fuse assembly comprising a second insulating housing, means within said second insulating housing for engaging a fuse, and terminal means associated with said engaging means for electrically connecting a fuse to apparatus to be protected, said fuse assemblies being removably disposed within said cavities to occupy a volume substantially within the confines of said length, width, and height of said first insulating housing; said second insulating housing comprising means defining a cutout preventing interference with the path of movement of said movable member.

6. A fuse assembly adapted for insertion into a cavity of an associated electric control device, said fuse assembly comprising:

an insulating housing defining a fuse-receiving volume, said housing comprising a top member, a bottom member, a front member, two side members, and an open back; said side members comprising means defining a cutout adapted to provide clearance for a movable operating member of the operating mechanism of an associated electric control device;

means within said volume for engaging a fuse; and terminal means for electrically connecting a fuse to apparatus being protected.

7. A fuse assembly as recited in claim 6 wherein said engaging means comprise a plurality of fuse clips mounted on the interior surface of said front member, said fuse clips having ears adapted to engage a fuse inserted through said open back, said fuse clips connected to said terminal means so as to insert said fuse electrically in series with said terminal means.

* * * * *